United States Patent [19]

Theurer et al.

[11] 4,113,111

[45] Sep. 12, 1978

[54] LOAD HANDLING VEHICLE WITH HYDRAULIC TORSION TRANSMITTING DEVICES

[75] Inventors: Josef Theurer, Vienna; Wilhelm Praschl, Linz-Urfahr; Klaus Riessberger, Vienna, all of Austria

[73] Assignee: Franz Plasser Bahnbaumaschinen-Industriegesellschaft M.B.H., Vienna, Austria

[21] Appl. No.: 672,276

[22] Filed: Mar. 31, 1976

[30] Foreign Application Priority Data

Apr. 25, 1975 [AT] Austria ..... 3222/75

[51] Int. Cl.[2] ..... B66C 23/00

[52] U.S. Cl. ..... 212/28; 280/104

[58] Field of Search ..... 214/660, 670–674; 280/104; 212/1 R, 28–29, 39

[56] References Cited

U.S. PATENT DOCUMENTS

| | | | |
|---|---|---|---|
| 1,298,928 | 4/1919 | Gragory | 280/104 |
| 1,313,167 | 8/1919 | Cosgrove | 280/104 |
| 2,828,138 | 3/1958 | Brueder | 280/104 |
| 3,439,630 | 4/1969 | Cope | 280/104 X |
| 3,439,631 | 4/1969 | Cope | 280/104 X |
| 3,885,809 | 5/1975 | Pitcher | 280/104 X |

FOREIGN PATENT DOCUMENTS

| | | | |
|---|---|---|---|
| 1,142,313 | 9/1957 | France | 280/104 |
| 1,461,002 | 10/1966 | France | 280/104 |

*Primary Examiner*—Drayton E. Hoffman
*Assistant Examiner*—R. B. Johnson
*Attorney, Agent, or Firm*—Kurt Kelman

[57] ABSTRACT

A vehicle with a spring-supported frame has torsion transmitting hydraulic cylinders arranged between the ends of the axles of the undercarriages and the frame. Each cylinder is in torsion transmitting connection with the frame and conduits interconnect corresponding cylinder chambers at each side of the vehicle.

8 Claims, 4 Drawing Figures

FIG. 3
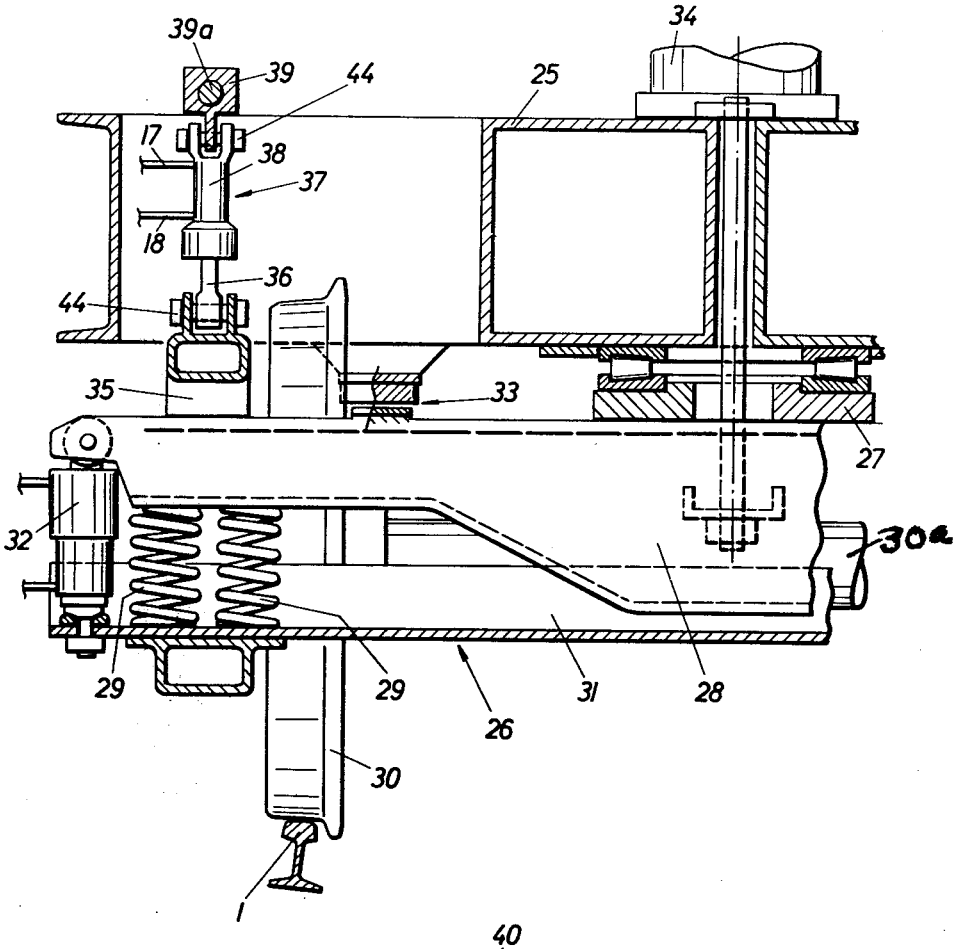
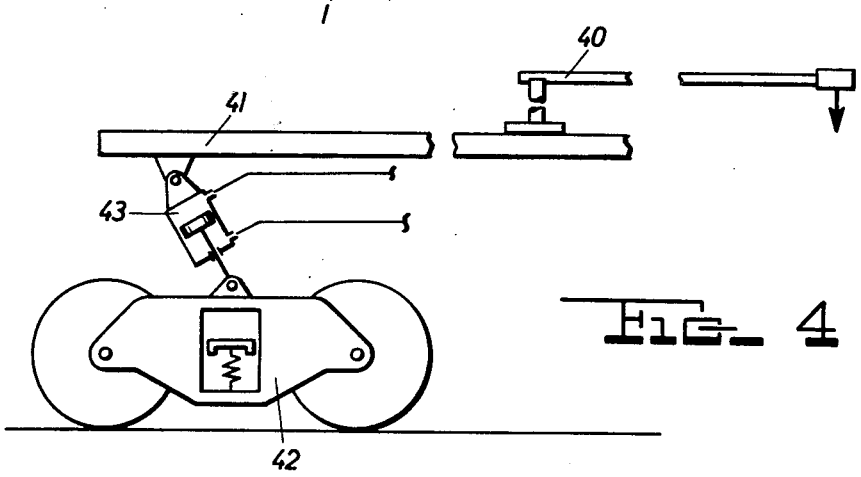
FIG. 4

LOAD HANDLING VEHICLE WITH HYDRAULIC TORSION TRANSMITTING DEVICES

SUMMARY OF THE INVENTION

The present invention relates to vehicles, and more particularly to vehicles running on a track and supporting unevenly distributed loads, such as mobile track working machines, rotary cranes and the like.

Vehicles of this type comprise two undercarriages each including an axle having two end regions and a vehicle frame mounted on the undercarriages and supporting the uneven load. Spring means, such as coil or leaf springs, chain links or the like, are mounted between the undercarriages and the frame as a yielding connection therebetween, and hydraulic torsion transmitting devices are arranged between the end regions of the axles and the frame. These devices consist of a cylinder member and a piston member dividing the cylinder member into two hydraulic chambers.

The uneven loads on such vehicles subject the road or track on which the vehicles move to uneven pressures. This disadvantage is particularly noticeable in mobile rotary cranes where heavy one-sided loads will subject one side of the undercarriages to extreme loads. This is bad for the vehicle as well as the right of way on which it moves.

Various attempts have been made to overcome this disadvantage by combining various spring and hydraulic shock absorber mechanisms in an effort to improve at least the moving quality of the vehicle but none of the known arrangements has been entirely successful. More particularly, none of the known shock absorber systems has solved the problem of the uneven load transmitted to the road or track, which has limited the maximum loads of such vehicles to avoid overloads on individual undercarriages.

It is the primary object of this invention to overcome these disadvantages of vehicles of the indicated type and to provide an arrangement which assures the satisfactory distribution of loads to all the undercarriages and wheels of the vehicle.

This and other objects are accomplished in a surprisingly simple manner according to the invention by providing a force-transmitting connection between the vehicle frame and the hydraulic torsion transmitting devices, and conduits between respective ones of the cylinder chambers at corresponding end regions of the axles of the undercarriages at each side of the vehicle and interconnecting the chambers.

This arrangement of the hydraulic torsion transmitting devices in parallel with the yielding spring connection between the vehicle frame and undercarriages subjects the frame to a torsion which takes some load off the wheels which are subjected to the load moment and redistributes it to those wheels which are relatively free from the load moment. Thus, the one-sided loads are redistributed by the vehicle frame to the other side by the torsion to which the frame is subjected, which causes a substantially even distribution of the load over all four wheels in almost any position of the vehicle. The magnitude of the yielding force between the undercarriages and vehicle frame depends on the stiffness of the springs and the resistance of the frame to torsion forces. Therefore, during operation of this load-distributing system of the present invention, the yielding spring means connections are not locked, i.e., they are permitted to function freely, since the resultant yield is advantageous in building up the pressure in the hydraulic devices, and subsequently, the torsion in the vehicle frame, thus assuring an equilibrium between all movements imparted to the vehicle.

BRIEF DESCRIPTION OF THE DRAWING

The above and other objects, advantages and features of this invention will become more apparent from the following detailed description of certain now preferred embodiments thereof, taken in conjunction with the accompanying drawing wherein

FIG. 3 shows a specific embodiment in a partial end view, partly in section, of a swivel truck or bogie forming the undercarriage of the vehicle; and FIG. 4 schematically shows another embodiment in a partial side view.

DETAILED DESCRIPTION OF PREFERRED EMBODIMENTS

Figure 1:
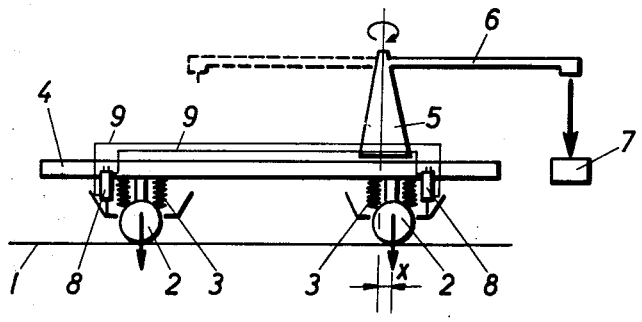
FIG. 1 is a schematic side view of a vehicle running on a track and supporting a rotary crane.

Referring now to the drawing and first to FIG. 1, there is shown a mobile rotary crane which comprises vehicle frame 4 mounted on undercarriages 2 each including a single axle, coil springs 3 being interposed between the undercarriages and the vehicle frame to provide a yielding connection therebetween. Rotary crane 5 is mounted on vehicle frame 4, with its rotary axis being spaced from the axle of adjacent undercarriage 2 by distance $x$ in the direction of track 1 on which the vehicle moves. The crane is rotatable about its axis extending perpendicularly to the plane of the track so that crane jib 6 may be oriented in any desired direction to pick up a load 7.

In accordance with the present invention, torsion transmitting hydraulic devices 8 are in force-transmitting connection with frame 4, being connected between the end regions of the axles of the undercarriages and the frame, and conduits 9 between respective cylinder chambers at corresponding end regions of the axles at each side of the vehicle interconnect these chambers. In the illustrated position of jib 6, the undercarriage at the right of FIG. 1 would normally sustain a much heavier load than that at the left. However, since the hydraulic chambers of the cylinders of both undercarriages are in communication, an even load will be automatically distributed over both undercarriages, as will become apparent from the following description of FIG. 2.

Figure 2:
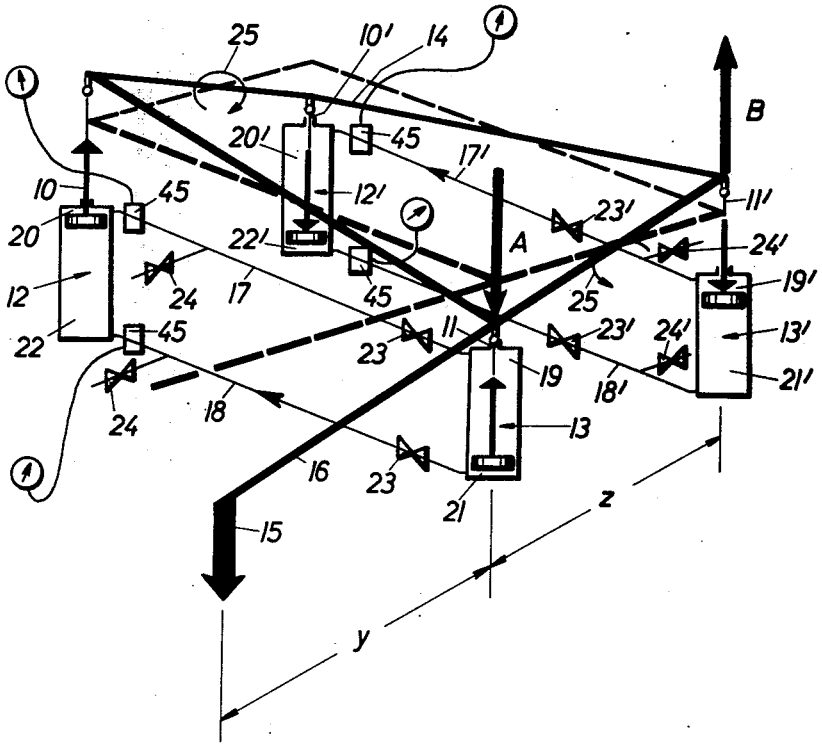
FIG. 2 diagrammatically illustrates the arrangement of the four hydraulic torsion transmitting devices of the invention.

While FIG. 1 shows the cylinder of the hydraulic devices linked to the vehicle frame and the piston rod linked to the undercarriages, this arrangement is reversed in FIG. 2 where piston rods 10, 10' and 11, 11' of hydraulic devices 12, 12' and 13, 13' are pivotally connected to vehicle frame 14 while the cylinders of these devices are linked to the undercarriages (not shown). The schematically illustrated vehicle frame is a rigid structure and, for simplicity's sake, crane jib 16 is shown to extend beyond the vehicle frame laterally and transversely to the longitudinal extension of the vehicle to receive load 15.

At each side of the vehicle, along the longitudinal extension of the vehicle, respective cylinder chambers 19, 20 and 21, 22 (and 19', 20' and 21' 22') are interconnected by conduits 17 and 18 (and 17' and 18') so as to permit hydraulic fluid to flow between the interconnected chambers of the two hydraulic devices on each side of the vehicle. Shut-off valves 23 (and 23') are mounted in the connecting conduits. In addition, the supply conduits leading to the connecting conduits also have shut-off valves 24 (and 24'). The shut-off valves in the connecting conduits have the advantage of enabling individual hydraulic devices to be disconnected from the system, if desired, so that the disconnected devices may operate simply as hydraulic shock absorbers. Shut-off valves 24 (and 24') in the supply conduits enable the cylinder chambers to be rapidly filled and emptied. Before operation of the vehicle, the hydraulic chambers of torsion transmitting devices 12, 13 and 12', 13' are filled with hydraulic fluid under small pressure, and after the chambers have been filled, shut-off valves 24 (and 24') are closed so as to provide a closed hydraulic system.

As will be obvious from a consideration of the operating diagram of FIG. 2, load 15 will cause one corner of vehicle frame 14 to be resiliently or yieldingly depressed while the two adjacent corners will correspondingly rise. The resultant pressure changes in the hydraulic cylinder chambers will correspondingly move the pistons and piston rods to exert a torsional force on the vehicle frame. In the illustrated embodiment, load 15 and crane jib 16 will transmit force A to hydraulic device 13 by depressing the piston in cylinder 13 and causing hydraulic fluid from chamber 21 to flow through conduit 18 into chamber 22 of device 12 while fluid from chamber 20 is forced back through conduit 17 into chamber 19. Simultaneously, oppositely directed force B will be transmitted in the opposite direction to hydraulic device 13' since the upwardly moving piston in cylinder 13' causes hydraulic fluid from chamber 19' to flow through conduit 17' into chamber 20' while fluid from chamber 22' is forced back through conduit 18' into chamber 21'. This transmission of oppositely oriented forces causes twisting of the rigid frame along the indicated heavy lines in the direction of arrows 25. Thus, the up or down thrust of one corner of the vehicle frame is transmitted to the other corner on the same side of the vehicle between the two undercarriages whereby the vehicle frame is subjected to torsion. In the same way, the forces emanating from load 15 are distributed. In other words, the illustrated hydraulic balancing system transmits torsion to the vehicle frame since each hydraulic device has one end connected directly to an undercarriage, preferably the chassis thereof, and is, therefore supported on the road or track while its other end is in force-transmitting connection with the frame, the hydraulic pressure forces flowing rectilinearly between the two ends of the device.

The operation of the four hydraulic devices associated with the four wheels of the vehicle causes changes in the static loads on the wheels. When crane jib 16 is laid out and load 15 is attached thereto, the loads on the wheels, which are the sum of the weight of the vehicle and the load distributed over it, change substantially. Assuming vehicle frame 14 to be supported on a double-axis swivel truck or bogie (such as shown in FIG. 4) on the track, the load forces will be distributed over eight wheels, four of the wheels running on the track rail adjacent jib 16 while the other four wheels run on the opposite track rail. In the illustrated position of jib 16, the following changes in the static loads Q on the wheels respectively associated with hydraulic devices 12' and 13' will occur:

Wheels associated with device 13', $$\Delta Q_{13'} = \frac{L\frac{Y}{Z} - P_K 12', 13'}{2} \text{ [tons]}$$

Wheels associated with device 12', $$\Delta Q_{12'} = \frac{P_K 12', 13'}{2} \text{ [tons]}$$

In the above equations, $P_K$12', 13' designates the piston force of devices 12' and 13', and this is calculated on the basis of the following equation:

$$P_K = \frac{L \cdot 2y \cdot c_r}{2\,(4c_r - c_f)} \text{ [tons]}$$

In the above equations, L is the load designated 15 in FIG. 2; $y$ is the length of crane jib 16 measured from the track rail, i.e., fixed support, associated with hydraulic devices 12, 13; $z$ is the distance between the planes in which the wheels at the respective ends of the undercarriage axles run; $c_r$ is the elasticity constant or spring force of springs 3; and $c_f$ is the elasticity constant of the vehicle frame.

Changes in the static loads on the wheels respectively associated with hydraulic devices 12, 13 will occur according to the following equations:

$$\Delta Q_{13} = \frac{L\frac{y+z}{z} - P_K 12, 13}{2} \text{ [tons]}$$

$$\Delta Q_{12} = \frac{P_K 12, 13}{2} \text{ [t]}$$

wherein $$P_K 12, 13 = \frac{L \cdot 2(y+z)c_r}{z(4c_r + c_f)} \text{ [tons]}$$

As the exemplary equations given hereinabove indicate, the balancing or equilibrium system of this invention produces a relief of the load on the wheels at the side of the load and a corresponding increase in the load on the wheels on the opposite side, due to the automatic piston movements in the closed hydraulic circuits interconnecting the hydraulic chambers on each side of the vehicle.

FIG. 3 shows a useful structural arrangement wherein one of the members, i.e., the piston or the cylinder, of the hydraulic device is pivotally connected or linked to the vehicle frame while the other hyraulic device member is pivotally connected or linked to the undercarriage, more particularly to the chassis of the undercarriage. This has structural advantages since it enables the hydraulic system to be readily adapted to various types of vehicle constructions.

FIG. 3 shows a part 25 of the vehicle frame supported on swivel truck or bogie 26 by turntable 27 interposed between undercarriage cradle 28 and the vehicle frame. Bogie 26 has axle 300 carrying wheels 30 running on track rails 1. In a track curve, turntable mounting 27 enables rotation of the swivel truck or bogie in relation to the vehicle frame about a vertical axis while any superelevation of the track is balanced by coil springs 29 mounted between cradle 28 and undercarriage carrier part 31 which unyieldingly mounts wheels 30. To avoid excessive resilient movement of cradle 28 and the vehicle frame with respect to unyielding undercarriage part 31, shock absorbers 32 of any conventional type are mounted between the ends of undercarriage part 31 and cradle 28. As schematically indicated in the drawing, the hydraulic shock absorbers have outlets for the hydraulic fluid therein to enable the spring movement to be limited, if desired, or even to eliminate any spring movement between the yieldingly mounted cradle of the undercarriage and the unyielding undercarriage part. Furthermore, a vertically adjustable cradle movement limiting stop 33 is interposed between vehicle frame part 25 and cradle 28 so that the operation of cradle springs 29 may be responsive to movements of vehicle frame part 25 according to adjusted values. The shock absorbers and/or the cradle movement limiting stop may be operated selectively to adapt the system to a variety of vehicle types and operating conditions, making it possible to distribute highly unevenly distributed heavy loads securely over all four wheels.

The rotary mounting of crane 34 on the vehicle frame is also shown schematically in FIG. 3.

The mounting of the hydraulic devices of the present invention is shown in connection with a hydraulic device 37 with its connecting conduits 17, 18 described hereinabove in connection with FIG. 2. As shown, undercarriage carrier part 31 has rigidly affixed thereto hydraulic device support 35 to which is pivotally connected piston rod 36 of the piston moving in cylinder 38 which is pivotally connected to vehicle frame part 25. Pivoting axes 44 of the pivotal connections extend substantially parallel to the axles of the undercarriage, i.e., transversely to the direction of movement of the vehicle and its longitudinal extension. Furthermore, in the illustrated embodiment, cylinder 38 is pivoted to element 39 guided on rod **39*a*** for displacing the pivoting connection between the cylinder and the vehicle frame in the direction of movement of the vehicle. This enables relative rotation of the undercarriage and the vehicle frame in curves while maintaining the effectiveness of the hydraulic load balancing system.

Hydraulic device 37 is a double-acting jack whose piston movement is responsive to the flow of hydraulic fluid through conduits 17 and 18 into and out of the cylinder chambers into which the piston divides the cylinder.

When vehicle frame 25 with cradle 28 and interposed turntable 27 is depressed in relation to undercarriage part 31, which is rigidly supported on track 1, coil springs 29 will be compressed and the resultant relative movement between piston rod 36 and cylinder 38 of hydraulic device 37 will build up pressure in the lower cylinder chamber. This pressure is transmitted through conduit 18 to the corresponding chamber in the cylinder of the hydraulic device on the same side of the vehicle, as has been explained in connection with FIG. 2, and leads to the even load distribution hereinabove described. Thus, the cradle springs are used in combination with the hydraulic devices of this invention to build up pressure in these devices. This is in contrast to known arrangements wherein it has been proposed to block the spring action between the undercarriage and the vehicle frame during operation of the crane to prevent tilting. Maintaining the spring action during operation according to the invention has the further advantage that, when the crane with its lifted load advances along the track and passes through a superelevated track section, such a superelevation will not exert a torsional force on the vehicle frame, as in the known apparatus which blocks spring action, but will be balanced by yielding springs 29. No change occurs in the wheel loads but only in the cradle spring loads.

Also, since the loads are supported primarily by the hydraulic devices of the present invention and the cradle springs need not support the same, the springs may be relatively soft to provide a readily yielding connection between the vehicle frame and the undercarriage, which increases the safety of the vehicle and decreases chances of derailment.

The embodiment illustrated in FIG. 4 shows swivel truck 42 supporting vehicle frame 41 on which rotary crane 40 is mounted. Hydraulic device 43 interposed according to the present invention between the undercarriage and the vehicle frame extends in a plane oblique to the vehicle frame, i.e., in the direction of movement of the vehicle. This oblique arrangement of the hydraulic load balancing devices with swivel trucks enables a better force distribution among the devices in very sharp curves which cause considerable relative rotary movement between the undercarriage and the vehicle frame. This arrangement also increases the stability of the vehicle against tilting, particularly with very uneven mass distribution, such as in a track working machine with ballast plows. The pivoting axes of the linked connections between the cylinder and piston rod of each hydraulic device and the undercarriage and vehicle frame, respectively, extend in a direction generally parallel to the axle of the undercarriage.

The invention is, of course, not limited to the herein described and illustrated embodiments. For instance, it may be desirable to make the pivotal connection between the piston rod or cylinder and the vehicle frame not only longitudinally but also laterally displaceable in a manner designed to comply with local regulations concerning required displacement limits between undercarriages and vehicle frames. For instance, in the embodiment of FIG. 3, the longitudinal guide 39, **39*a*** should have some lateral play to adjust to lateral movements between the swivel truck and the vehicle frame. Similar tolerances for movement between undercarriage and vehicle frame will be observed in all types of vehicles.

Furthermore, it will be useful to mount pressure gages in the hydraulic circuit conduits interconnecting the hydraulic devices and to provide these gages with indicators to enable an operator to ascertain the prevailing pressures and loads on the wheels. This pressure gage may also be connected to an indicating instrument calibrated to show permissible pressures and loads so as to enable an operator to make certain that such pressures and loads are maintained.

We claim:

1. A vehicle comprising two undercarriages each having an axle carrying two wheels at respective end regions of the axle and a substantially rigid vehicle frame mounted on the undercarriages, a rotary load handling apparatus mounted on the vehicle frame for rotary movement thereon about a vertical axis and operative to apply a torsion force to said vehicle frame in one of the said end regions when lifting or supporting a load, spring means mounted between the undercarriages and the said vehicle frame as a yielding connection therebetween, and double-acting hydraulic torsion transmitting devices arranged separately and independently from the spring means, means mounting said torsion transmitting devices on the said undercarriages between the end regions of the axles and the said vehicle frame and being in force transmitting connection with the said frame, each of the said devices consisting of a cylinder member and a piston member dividing the cylinder member into an upper and a lower chamber, means connecting one of the said members directly to an associated one of the said undercarriages, and a respective conduit between the said upper chambers and the said lower chambers, respectively, of the said devices at corresponding end regions of the axles at each side of the vehicle, the conduits interconnecting the said upper and lower chambers of the said devices, respectively, for free and unobstructed flow of hydraulic fluid between the interconnected chambers, the said devices and interconnecting conduits forming a closed hydraulic system at each side of the vehicle, means connected to said conduits for selectively converting said torsion transmitting devices to shock absorbers, and the said cylinder chambers and conduits being filled with the hydraulic fluid whereby the torsional force in the said one end region is transmitted to the device in the one end region in a downward direction and to the interconnected device at the same side of the vehicle in an upward direction thereby twisting the said vehicle frame and distributing said force thereover.

2. The vehicle of claim 1, wherein one of the members of each of the said devices is linked to the vehicle frame and the other member thereof is linked to the associated undercarriage.

3. The vehicle of claim 2, wherein the said members are linked to the vehicle frame and the associated undercarriage, respectively, for pivoting about axes extending substantially parallel to the axles of the undercarriages.

4. The vehicle of claim 3, further comprising means for displacing the pivoting linking connection between the one member and the vehicle frame in the direction of movement of the vehicle.

5. The vehicle of claim 1, wherein the undercarriages are swivel trucks and the hydraulic torsion transmitting devices extend in planes oblique to the vehicle frame.

6. The vehicle of claim 1, further comprising means for limiting relative vertical movement caused by the yielding connection between the undercarriage and the vehicle frame.

7. The vehicle of claim 1, further comprising means for limiting resilient action of the spring means.

8. In the combination of two swivel trucks and a vehicle frame mounted on the trucks for relative rotation in relation thereto about a vertical axis, each swivel truck having an axle carrying two wheels for moving the vehicle frame on a track and including a carrier frame for the wheels, a cradle mounted on the carrier frame, compression spring means mounted between the said frame and cradle, the cradle supporting the vehicle frame and the spring means forming a yielding connection between the swivel trucks and the said vehicle frame, shock absorber means interposed between the cradle and the carrier frame, and a crane mounted on the vehicle frame and capable of applying an asymmetric load to the vehicle frame, the improvement of double-acting hydraulic torsion transmitting devices arranged separately and independently from the compression spring means, the said torsion transmitting devices being supported on the said swivel trucks between each of the said swivel trucks and the said vehicle frame in the region of the wheels and being in force transmitting connection with the said frame, each of the said devices consisting of a cylinder member and a piston member dividing the cylinder member into an upper and a lower chamber, means pivotally connecting one of the said members to the said vehicle frame and the other member to the carrier frame of an associated ones of the said swivel trucks, and a respective conduit between the said upper chambers and the said lower chambers, respectively, of the said devices at corresponding regions of the wheels at each side of the vehicle, the conduits interconnecting the said upper and lower chambers of the said devices, respectively, for free and unobstructed flow of hydraulic fluid between the interconnected chambers, the said devices and interconnecting conduits forming a closed hydraulic system at each side of the vehicle, and the said cylinder chambers and conduits being filled with the hydraulic fluid whereby the load in the said one end region is transmitted to the device in the one end region in a downward direction and to the interconnected device at the same side of the vehicle in an upward direction thereby twisting the said vehicle frame and distributing the load thereover.

* * * * *